US006084500A

United States Patent [19]

Kanetaka et al.

[11] Patent Number: 6,084,500

[45] Date of Patent: Jul. 4, 2000

[54] CHIP INDUCTOR AND METHOD FOR MANUFACTURING THE SAME

[75] Inventors: Toyonori Kanetaka, Toyooka; Toshihiro Yoshizawa, Higashiosaka; Akira Fujimori, Toyooka; Mikio Taoka, Neyagawa; Hideaki Nakayama, Toyooka, all of Japan

[73] Assignee: Matsushita Electric Industrial Co., Ltd., Osaka, Japan

[21] Appl. No.: 09/147,314

[22] PCT Filed: Mar. 26, 1998

[86] PCT No.: PCT/JP98/01349

§ 371 Date: Nov. 25, 1998

§ 102(e) Date: Nov. 25, 1998

[87] PCT Pub. No.: WO98/44520

PCT Pub. Date: Oct. 8, 1998

[30] Foreign Application Priority Data

Mar. 28, 1997 [JP] Japan ..... 9-076989
Mar. 28, 1997 [JP] Japan ..... 9-076990

[51] Int. Cl.[7] ..... H01F 5/00; H01F 27/28

[52] U.S. Cl. ..... 336/223; 29/606; 336/200; 336/232

[58] Field of Search ..... 336/200, 232, 336/223; 29/606, 609

[56] References Cited

U.S. PATENT DOCUMENTS 5,441,783 8/1995 Silgailis et al. ..... 428/37
5,764,126 4/1997 Kanetaka et al. ..... 336/223

FOREIGN PATENT DOCUMENTS 6-215950 5/1994 Japan .

*Primary Examiner*—Michael L. Gellner
*Assistant Examiner*—Anh Mai
*Attorney, Agent, or Firm*—McDermott, Will & Emery

[57] ABSTRACT

The invention relates to a chip inductor and its manufacturing method, in which an appropriate insulation is applied between adjacent linear conductors of the coil unit to prevent occurrence of short-circuit and to enhance electric characteristics, and moreover the mounting surface by the exterior unit is a flat surface, so that appropriate mounting is realized. The constitution includes a square columnar main body (1) made of an insulating material, electrode units (6) disposed at both ends of this main body (1), a coil unit (5) connected to the electrode units (6) and disposed on the outer circumference of the main body (1) between the electrode units (6), and an exterior unit (9) having this coil unit (5) coated with an insulating resin (8), in which the coil unit (5) includes linear conductors (3) and grooves (4) formed by grooving a conductor layer (2) covering the surface of the main body (1), and the insulating resin (8) is also formed in the entire inside of the grooves (4).

6 Claims, 7 Drawing Sheets

CHIP INDUCTOR AND METHOD FOR MANUFACTURING THE SAME

TECHNICAL FIELD

The present invention relates to a chip inductor used in electronic appliances, communication appliances, and others, and its manufacturing method.

BACKGROUND ART

In FIG. 6 to FIG. 9, a conventional chip inductor comprises a square columnar main body 21 made of an insulating material, a coil unit 25 having a linear conductor 23 and a groove 24 formed by spirally grooving a conductor layer 22 on the surface of the main body 21, an exterior unit 29 made of an insulating resin 28 applied on the surface of the coil unit 25, and an electrode unit 26 provided at the end portion of the main body 21.

Its manufacturing method comprises a first step of forming a conductor layer 22 on a square columnar main body 21 made of an insulating material, a second step of forming a coil unit 25 having a linear conductor 23 and a groove 24 by grooving the conductor layer 22 by laser 27, a third step of forming electrode units 26 at both ends of the coil unit 25, and a fourth step of forming an exterior unit 29 by coating the coil unit 25 with an insulating resin 28 and drying.

Herein, at the fourth step, while rotating the main body 21 forming the coil unit 25 in the direction of arrow A in FIG. 9(*c*), on the tape to which the insulating resin 28 is adhered, the insulating resin 28 is applied on the coil unit 25, and the entire circumference of the coil unit 25 is coated with the insulating resin 28.

By drying this insulating resin 28, the exterior unit 29 is formed.

In such conventional constitution, the insulating resin 28 is applied on the surface of the coil unit 25, but the insulating resin 28 was not applied in the inner part of the groove 24 of the coil unit 25.

Generally, in a very small part such as chip inductor (overall dimension being about 1 mm), the interval of adjacent linear conductors 23 in the coil unit 25 is as narrow as scores of microns, and it is hard to coat the insulating resin 28 due to effects of surface tension and others of the insulating resin 28, and coated portions and uncoated portions of the insulating resin 28 coexisted inside the groove 24.

As a result, gaps 40 were formed inside the groove 24 as shown in FIG. 7, and due to air or moisture in the gaps 40, appropriate insulation is not provided between the adjacent linear conductors 23 of the coil unit 25, and short-circuit is caused.

Also in the conventional method, since the insulating region 28 is applied on the coil unit 25 while rotating the main body 21 forming the coil unit 25 on the tape to which the insulating resin 28 is adhered, as shown in FIG. 8, the insulating resin 28 applied on the coil unit 25 forms a circular profile, while surrounding the square columnar main body 21 due to the surface tension.

As a result, the mounting surface by the exterior unit 29 is round, and when mounting a packed substrate or the like, accurate mounting is difficult, and gaps 40 are likely to be formed in the groove 24.

DISCLOSURE OF THE INVENTION

It is hence an object of the invention to present a chip inductor capable of preventing short-circuit and enhancing the electric characteristics by applying an appropriate insulation between adjacent linear conductors of the coil unit, and mounting appropriately by forming a flat mounting surface in the exterior unit, and its manufacturing method.

To achieve the object, the invention is characterized by a constitution comprising a square columnar main body made of an insulating material, electrode units disposed at both sides of the main body, a coil unit connected to the electrode units, and disposed on the outer circumference of the main body between the electrode units, and an exterior unit having the coil unit coated with an insulating resin, in which the coil unit has linear conductors and grooves formed by grooving the conductor layer applied on the surface of the main body, and the insulating resin is also provided in the entire inside of the grooves.

Its manufacturing method comprises a first step of forming a conductor layer on a square columnar main body made of an insulating material, a second step of forming a coil unit having linear conductors and grooves by grooving the conductor layer, a third step of forming electrode units at both ends of the coil unit, and a fourth step of forming an exterior unit by coating the coil unit with an insulating resin and drying, in which the fourth step is intended to form the exterior unit by first coating the coil unit formed on one side of the main body with an insulating resin and drying, then coating the coil unit formed on other side with an insulating resin and drying.

In this constitution, since the insulating resin is provided also in the entire inside of the groove, there is no gap in the groove, and air or moisture is forced out, and appropriate insulation can be applied between linear conductors, so that short-circuit can be prevented.

Also, in this method, in the coil unit formed on the surface to which the main body is adjacent, the insulating resin is applied and dried on the coil unit formed at one side, and then the insulating resin is applied and dried on the coil formed at other side, thereby forming the exterior unit. In this case, the insulating resins applied on the coil units at the adjacent sides are not formed in a circular external shape due to mutual effects of surface tension because one side is already cured. Moreover, since the area of applying and drying the insulating resin in one step is small, the surface tension is smaller, and the insulating resin is easily applied in the entire inside of the groove.

As a result, in the square columnar main body, the insulating resin is also applied in a square columnar form, and an exterior unit of square columnar form is fabricated, and the mounting surface on the exterior unit is flat, and mounting on packed substrate or the like is improved, and the insulating resin may be easily applied to the entire inside of the groove of the coil unit.

BEST MODE FOR CARRYING OUT THE INVENTION

A chip inductor in an embodiment of the invention is described in detail below by referring to the accompanying drawings.

Figure 1:
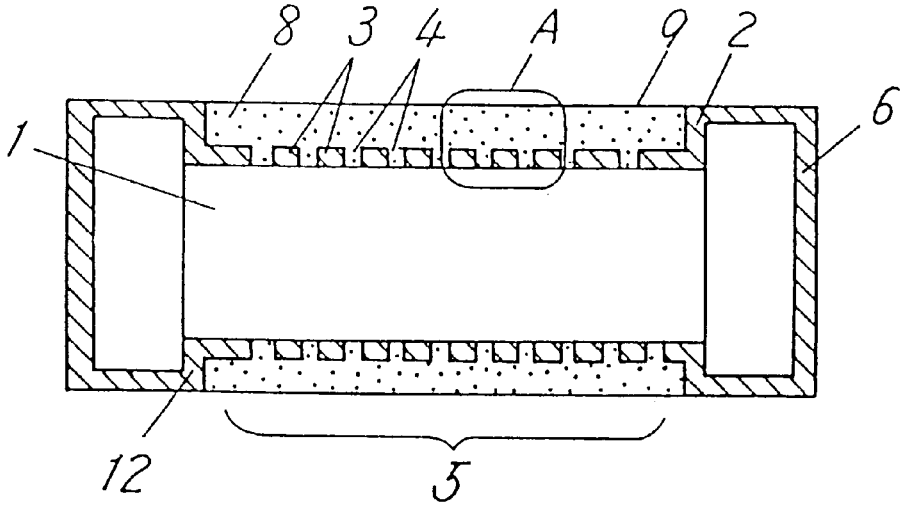
FIG. 1 is a sectional view of a chip inductor in an embodiment of the invention.
Figure 2:
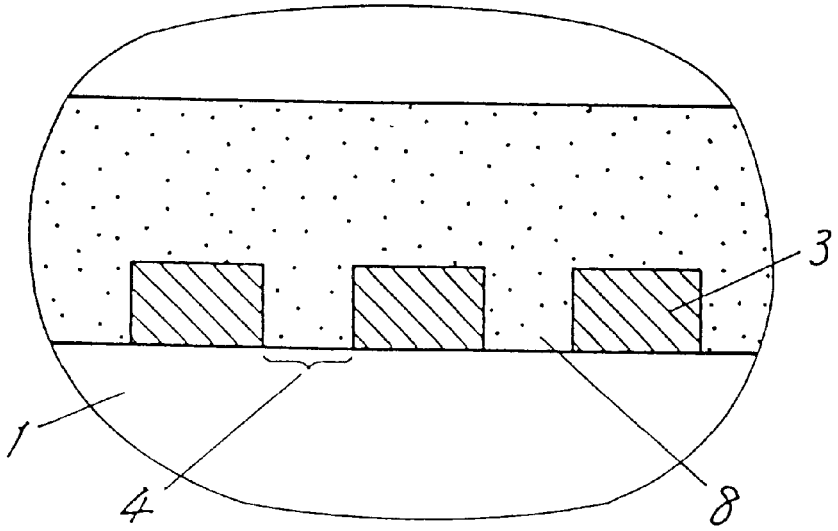
FIG. 2 is a magnified sectional view near the coil unit (part A in FIG. 1) of the same chip inductor.
Figure 3:
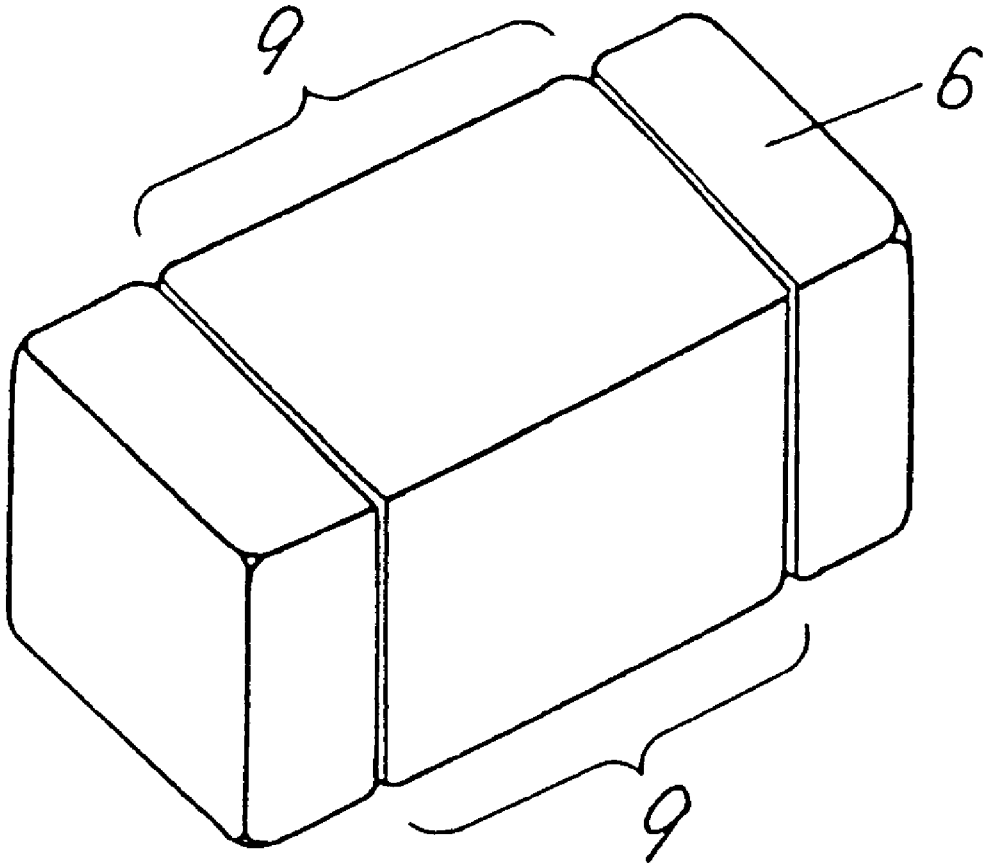
FIG. 3 is a perspective view of the same chip inductor, FIGS. 4(*a*) to (*e*) are perspective views showing a series of forming steps of the chip inductor, and FIGS. 5(*a*) to (*c*) are sectional views showing the formed state of the exterior unit of the same chip inductor.
Figure 4A:
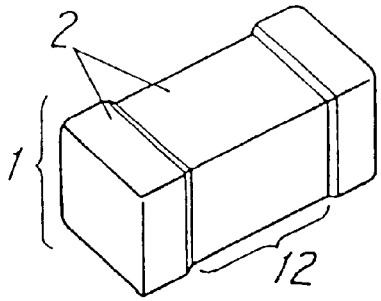
Figure 4B:
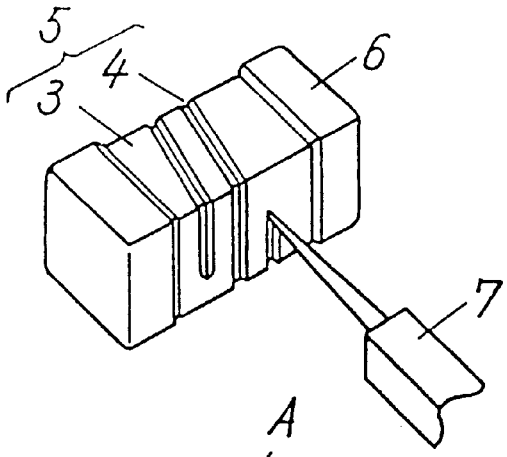
Figure 4C:
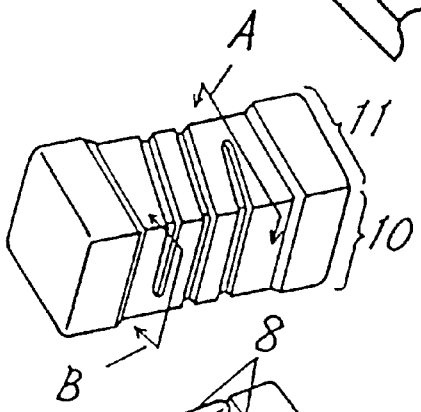
Figure 4D:
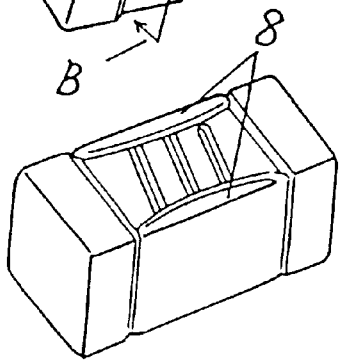
Figure 4E:
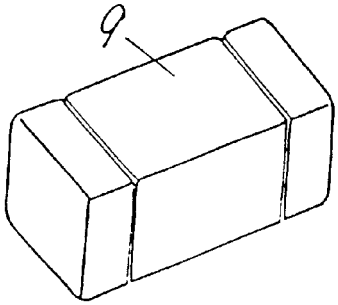
Figure 5A:
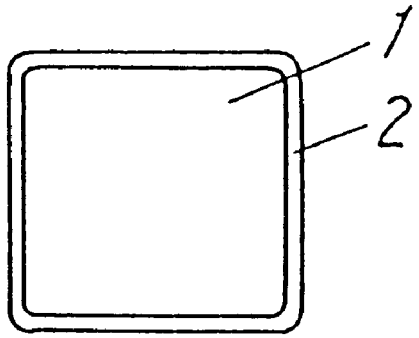
Figure 5B:
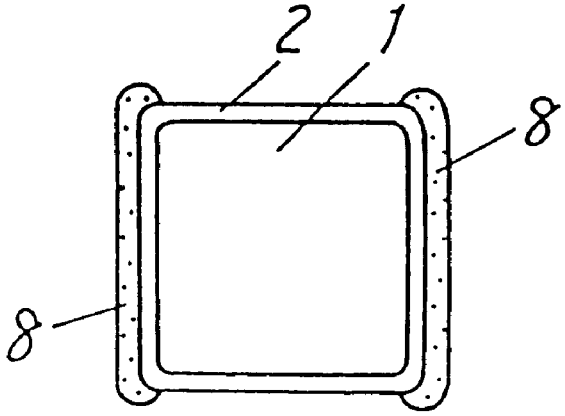
Figure 5C:
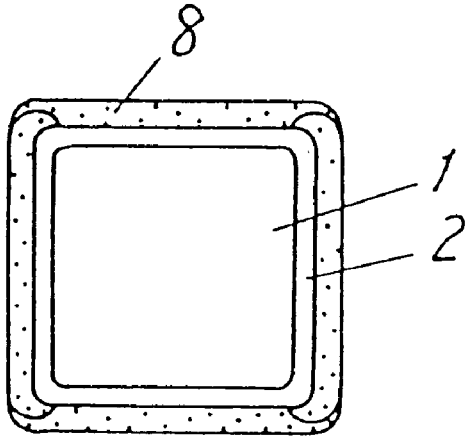
Figure 6:
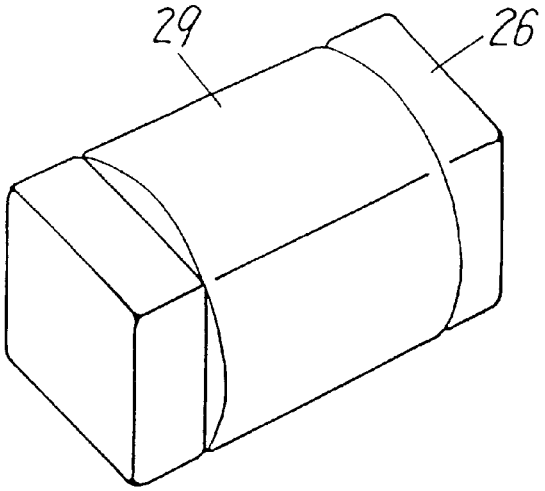
FIG. 6 PRIOR ART
FIG. 6 is a perspective view of a conventional chip inductor.
Figure 7:
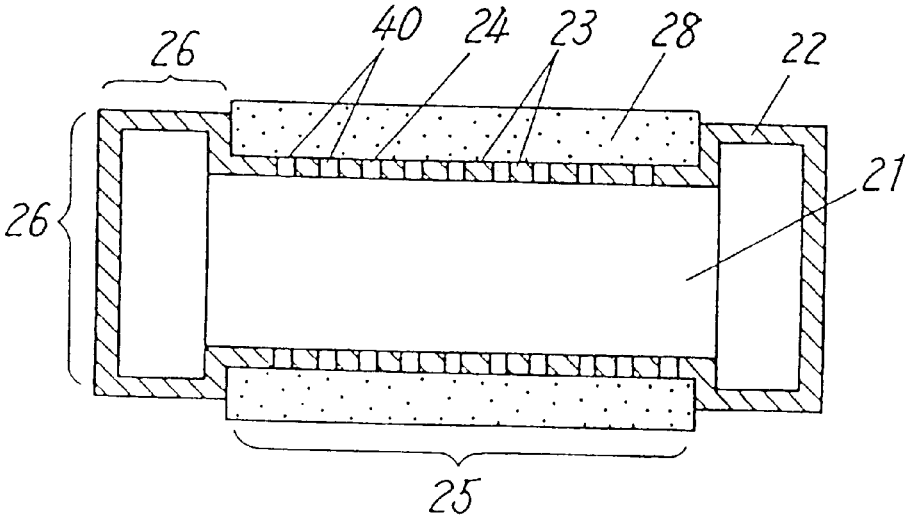
FIG. 7 PRIOR ART
FIG. 7 is a sectional view of the same chip inductor.
Figure 8:
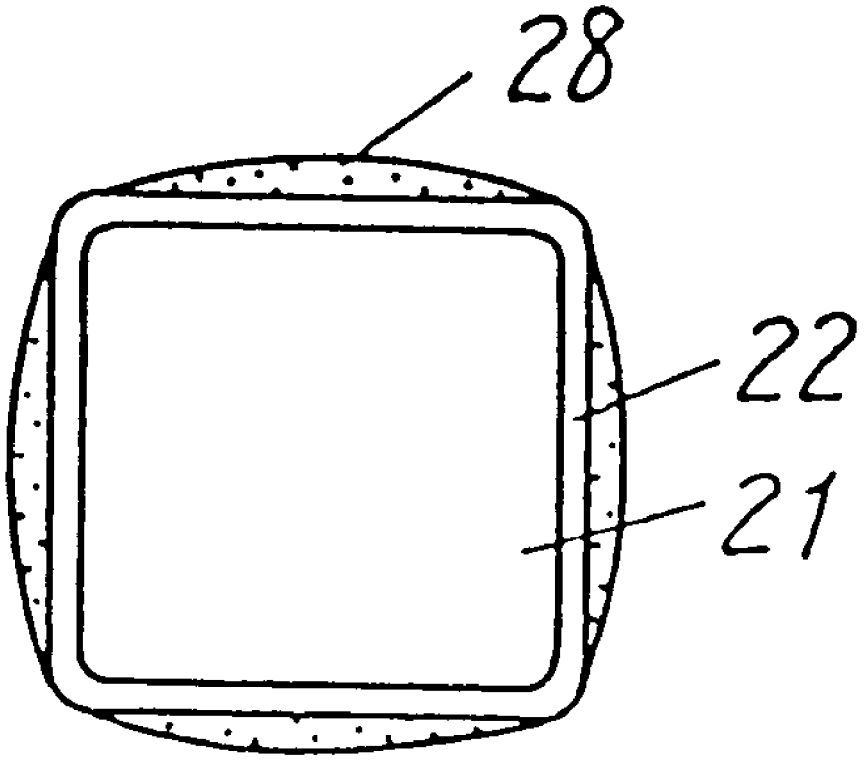
FIG. 8 PRIOR ART
FIG. 8 is a sectional view showing the formed sate of the exterior unit of the same chip inductor, and FIGS. 9(*a*) to (d) are perspective views showing a series of forming steps of the same chip inductor.
Figure 9A:
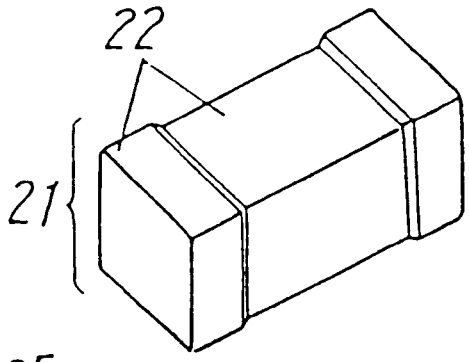
FIG. 9(a) PRIOR ART
Figure 9B:
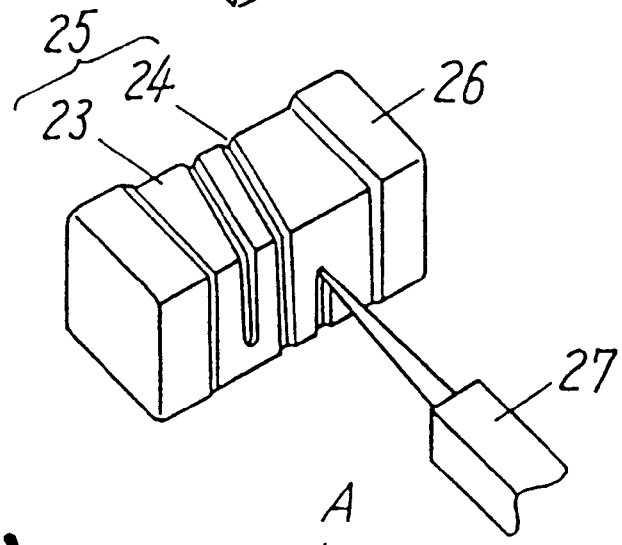
FIG. 9(b) PRIOR ART
Figure 9C:
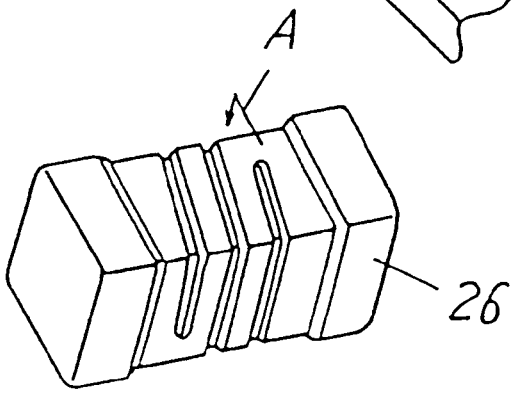
FIG. 9(c) PRIOR ART
Figure 9D:
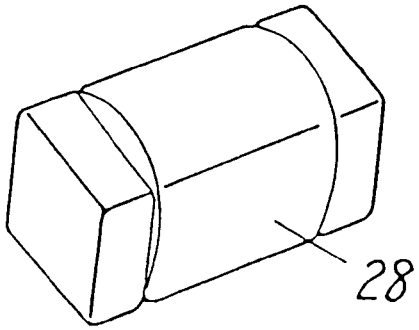
FIG. 9(d) PRIOR ART

In FIG. 1 to FIG. 5, a chip inductor in an embodiment of the invention comprises a square columnar main body 1 made of an insulating material, electrode units 6 disposed at both ends of this main body 1, a coil unit 5 connected to the electrode units 6 and disposed on the outer circumference of the main body 1 between the electrode units 6, and an exterior unit 9 having the coil unit 5 coated with an insulating resin 8.

The coil unit 5 includes linear conductors 3 and grooves 4 formed by grooving a conductor layer 2 covering the surface of the main body 1, and the insulating resin 8 is also formed in the entire inside of the grooves 4.

Further, recesses 12 are formed in all side surfaces except for the end surface of the main body 1, and the coil unit 5 is formed in the recesses 12, and the insulating resin 8 is formed inside the recesses 12.

The insulating resin 8 is a thixotropic epoxy resin.

Its manufacturing method comprises a first step of forming a conductor layer 2 on a square columnar main body 1 made of an insulating material, a second step of forming a coil unit 5 having linear conductors 3 and grooves 4 by grooving the conductor layer 2 by laser 7, a third step of forming electrode units 6 at both ends of the coil unit 5, and a fourth step of forming an exterior unit 9 by coating the coil unit 5 with an insulating resin 8 and drying.

The second step also includes a step of removing conductor chips formed when grooving the conductor layer 2, in which etching removal method, sand blasting removal method, or the like is employed.

At the fourth step, moreover, in the coil unit 5 formed at adjacent sides of the main body 1, after coating the coil unit 5 formed at one side 10 in direction A in FIG. 4 (*c*) with the insulating resin and drying, the coil unit 5 formed at other side in direction B in FIG. 4 (*c*) is coated with the insulating resin 8 and dried, thereby forming the exterior unit 9.

At this time, the main body 1 has a square columnar shape, and recesses 12 are formed in all sides of the main body 1, and the coil unit 5 is provided in the recesses 12, and, at the fourth step, after coating the coil unit 5 formed at one confronting side 10 of the main body 1 with the insulating resin 8 and drying, the coil unit 5 formed in other confronting side 11 is coated with the insulating resin 8 and dried to form the exterior unit 9, and the insulating resin 8 is formed within the recess 12 so as not to ooze outside of the recess 12.

When coating with the insulating resin 8, the entire inside of the groove 4 is also coated, and a transfer coating process by a roller is employed.

The insulating resin 8 used herein is a thixotropic epoxy resin.

The operation of the chip inductor having such constitution is described below.

Since the insulating resin 8 is provided also in the entire inside of the grooves 4, there is no gap in the grooves 4, and air or moisture is forced out, and an appropriate insulation is guaranteed between the adjacent linear conductors 3, and short-circuit can be prevented.

In the recess 12 having the coil unit 5, at least the insulating resin 8 is provided, and therefore the level of the insulating resin 8 is not higher than the level of the electrode units 6 at both sides of the recess 12, and the square columnar plane of the main body 1 can be used as the mounting surface, and the mounting performance on packed substrate or the like is improved. In particular, since the recess 12 is formed in all sides except for the end face of the main body 1 to cover the insulating resin 8, it is possible to mount on any side, and the productivity is enhanced.

Moreover, since the insulating resin 8 is a thixotropic epoxy resin, shape change does not occur when curing the insulating resin 8, and the surface shape of the exterior unit 9 can be accurately defined in a plane, and the mounting performance may be enhanced.

Also according to this manufacturing method, in the coil units 5 formed at adjacent sides of the main body 1, after coating the coil unit 5 formed at one side 10 with the insulating resin 8 and drying, the coil unit 5 formed in other side 11 is coated with the insulating resin 8 and dried to form the exterior unit 9. In this case, of the insulating resins 8 applied on the coil units 5 at the adjacent sides, since one side has been already cured, the external shape does not become circular due to mutual effects of surface tension.

Still more, the area of coating with the insulating resin 8 and drying in one step is smaller, and the surface tension is smaller, and therefore it is easy to coat the entire inside of the groove 4 with the insulating resin 8.

As a result, in the square columnar main body 1, the insulating resin 8 is also applied in a square columnar shape, and the square columnar exterior unit 9 is formed, and the mounting surface by the exterior unit 9 is a flat shape, and the mounting performance on a packed substrate or the like may be enhanced.

Since the coil units 5 formed at the confronting one side 10 and other side 11 of the main body 1 are coated with the insulating resin 8 and dried, the process of forming the exterior unit 9 on the main body 1 is finished in two steps, and the manufacture may be simplified.

Since the entire inside of the groove 4 is coated with the insulating resin 8, gap is not formed in the groove 4, and corrosion or short-circuit between the adjacent linear conductors 3 due to air or moisture in the gap may be prevented, and it is also effective to prevent short-circuit between the adjacent linear conductors 3 by conductor chips or other dust formed at the time of grooving the conductor layer 2.

Since the insulating resin 8 is formed in the recess 12 provided in the sides of the main body 1, the level of the insulating resin is not higher than the level of the electrode units 6 at both ends of the recess 12, and the mounting performance on a packed substrate or the like may be enhanced.

Since conductor chips formed when grooving the conductor layer 2 are removed, it is effective to prevent short-circuiting between the adjacent linear conductors 3 due to the conductor layer of a conductive matter, or prevent change of inductance value due to deposit on the linear conductors 3, thereby enhancing the electric characteristics.

Since the insulating resin 8 is a thixotropic epoxy resin, when coated with the insulating resin 8, the exterior unit 9 can be formed by drying and curing while maintaining the shape of coating. As a result, shape changes when curing the insulating resin 8 are smaller, the shape of the surface of the exterior unit 9 can be defined, and the mounting performance is enhanced..

Moreover, since the insulating resin 8 is applied by transfer coating process, the insulating resin 8 can be applied very sparingly and uniformly. Therefore, the sectional area of the main body 1 may be extended to the maximum limit, and the size can be reduced while maximizing the inductance value attributable to the sectional area of the main body 1.

Thus, according to the invention, there is no gap in the grooves 4, and air or moisture is forced out, and an appropriate insulation is guaranteed between the linear conductors 3, and short-circuit can be prevented, and therefore the electric characteristics may be enhanced.

The level of the insulating resin 8 is not higher than the level of the electrode units 6 at both sides of the recess 12, and the square columnar plane of the main body 1 can be used as the mounting surface, and the mounting performance on packed substrate or the like is improved, and moreover, since the recess 12 is formed in all sides except for the end face of the main body 1 to cover the insulating resin 8, it is possible to mount on any side, and the productivity is enhanced.

Moreover, since the insulating resin 8 is a thixotropic epoxy resin, shape change does not occur when curing the insulating resin 8, and the surface shape of the exterior unit 9 can be accurately defined in a plane, and the mounting performance may be enhanced.

Also according to this manufacturing method, in the square columnar main body 1, the insulating resin 8 is also applied in a square columnar shape, and the square columnar exterior unit 9 is formed, and the mounting surface by the exterior unit 9 is a flat shape, and the insulating resin 8 is provided in the recess 12 formed at the side of the main body 1, and therefore the level of the insulating resin is not higher than the level of the electrode units 6 at both ends of the recess 12, and the mounting performance on packed substrate or the like is enhanced. In particular, since the insulating resin 8 is a thixotropic epoxy resin, the shape of the surface the exterior unit 9 can be defined, and the mounting performance may be further improved.

Since the insulating resin 8 is also applied in the gap, corrosion or short-circuit between adjacent linear conductors 3 can be prevented, and deterioration in use in high frequency current region can be suppressed, and further by transfer coating process, the insulating resin 8 can be applied very sparingly and uniformly, and the size may be reduced while maximizing the inductance value.

Conductor chips formed when grooving the conductor layer 2 are removed, which prevents occurrence of short-circuit between the adjacent linear conductors 3 due to the conductive matter formed by conductor chips or change of inductance value due to deposit on the linear conductor 3, thereby enhancing the electric characteristics.

Since the coil unit 5 formed at the confronting one side 10 of the main body 1 and the coil unit 5 formed at the confronting other side 11 are coated with the insulating resin 8 and dried, the process of forming the exterior unit 9 on the main body 1 is finished in two steps, and the manufacture may be simplified.

Meanwhile, in the embodiment of the invention, the exterior unit 9 is formed on the main body 1 in two steps, but the exterior unit may be also formed in several steps, by applying and drying the insulating resin 8 sequentially in each side of the side surfaces of the main body 1.

Incidentally, the method of removing conductor chips may be also other method than the etching removal method or sand blasting removal method.

INDUSTRIAL APPLICABILITY

Thus, the invention is characterized by a constitution comprising a square columnar main body made of an insulating material, electrode units disposed at both sides of the main body, a coil unit connected to the electrode units, and disposed on the outer circumference of the main body between the electrode units, and an exterior unit having the coil unit coated with an insulating-resin, in which the coil unit has linear conductors and grooves formed by grooving the conductor layer applied on the surface of the main body, and the insulating resin is provided also in the entire inside of the grooves.

In this constitution, since the insulating resin is provided also In the entire inside of the groove, there is no gap in the groove, and air or moisture is forced out, and appropriate insulation can be applied between linear conductors, so that short-circuit can be prevented, and therefore the chip inductor enhanced in the electric characteristics can be presented.

Its manufacturing method comprises a first step of forming a conductor layer on a square columnar main body made of an insulating material, a second step of forming a coil unit having linear conductors and grooves by grooving the conductor layer, a third step of forming electrode units at both ends of the coil unit, and a fourth step of forming an exterior unit by coating the coil unit with an insulating resin and drying, in which the fourth step is intended to form the exterior unit by first coating the coil unit formed on one side of the main body with an insulating resin and drying, then coating the coil unit formed on other side with an insulating resin and drying.

Also, in this method, in the coil unit formed on the surface to which the main body is adjacent,.the-insulating resin is applied and dried on the coil unit formed at one side, and then the insulating resin is applied and dried on the coil formed at other side, thereby forming the exterior unit. Therefore, the insulating resins applied on the coil units at the adjacent sides are not formed in a circular external shape due to mutual effects of surface tension because one side is already cured.

As a result, in the square columnar main body, the insulating resin is also applied in a square columnar form, and an exterior unit of square columnar form is fabricated, and the mounting surface on the exterior unit is flat, so that a chip inductor enhanced in mounting on packed substrate or the like is presented.

What is claimed is:

1. A manufacturing method of a chip inductor comprising:

a first step of forming a conductor layer on a square columnar main body made of an insulating material, a second step of forming a coil unit having linear conductors and grooves by grooving said conductor layer, a third step of forming electrode units at both ends of said coil unit, and a fourth step of coating said coil unit with an insulating resin and drying so as to provide said insulating resin in the entire inside of said grooves, said insulating resin being deposited by first coating a first side of said square columnar main body and drying said insulating resin deposited on said first side, and coating a second side of said square columnar main body and drying said insulating resin deposited on said second side, and performing said same process on a third side and a fourth side of said square columnar main body.

2. A manufacturing method of a chip inductor of claim 1, further comprising a step of coating also the entire inside of the grooves with the insulating resin.

3. A manufacturing method of a chip inductor of claim 1, further comprising a step of forming recesses in side surfaces of the main body, forming the coil unit at least in said recesses, and forming the insulating resin inside said recesses.

4. A manufacturing method of a chip inductor of claim 1, further comprising a step of removing conductor chips formed when grooving the conductor layer.

5. A manufacturing method of a chip inductor of claim 1, wherein the insulating resin is a thixotropic epoxy resin.

6. A manufacturing method of a chip inductor of claim 1, wherein coating is applied by transfer coating process.

* * * * *